US008146474B2

(12) United States Patent
Szymanski

(10) Patent No.: US 8,146,474 B2
(45) Date of Patent: Apr. 3, 2012

(54) WOOD CUTTING SAW CHAIN AND REPLACEABLE CUTTING MEMBERS

(75) Inventor: David Szymanski, St. Marys, PA (US)

(73) Assignee: Indigo Innovators, Inc., St. Mary's, PA (US)

( * ) Notice: Subject to any disclaimer, the term of this patent is extended or adjusted under 35 U.S.C. 154(b) by 0 days.

(21) Appl. No.: 12/125,289

(22) Filed: May 22, 2008

(65) Prior Publication Data

US 2008/0264230 A1 Oct. 30, 2008

Related U.S. Application Data

(63) Continuation-in-part of application No. 10/780,323, filed on Feb. 17, 2004.

(51) Int. Cl.
*B27B 33/12* (2006.01)
*B27B 33/14* (2006.01)

(52) U.S. Cl. ..... 83/831; 83/830; 83/834; 83/839

(58) Field of Classification Search ..... 83/830–834, 83/835, 838–845
See application file for complete search history.

(56) References Cited

U.S. PATENT DOCUMENTS

| | | | | | |
|---|---|---|---|---|---|
| 2,583,243 | A | * | 1/1952 | Tweedie | 83/831 |
| 2,664,120 | A | * | 12/1953 | Hinkley | 83/831 |
| 2,746,494 | A | * | 5/1956 | Cox | 83/831 |
| 2,852,048 | A | * | 9/1958 | Cox | 83/831 |
| 2,976,900 | A | * | 3/1961 | Mills | 83/834 |
| 3,292,675 | A | * | 12/1966 | Bullard | 83/834 |
| 3,528,465 | A | * | 9/1970 | Omley | 83/842 |
| 3,547,167 | A | * | 12/1970 | Raetz | 83/830 |
| 3,800,633 | A | * | 4/1974 | Funakubo | 76/112 |
| 4,462,293 | A | * | 7/1984 | Gunzner | 83/855 |
| 4,563,929 | A | * | 1/1986 | Ringlee et al. | 83/840 |
| 4,727,778 | A | * | 3/1988 | Omi | 76/112 |
| 4,744,278 | A | | 5/1988 | Wright | |
| 4,750,396 | A | * | 6/1988 | Gaddis et al. | 83/844 |
| 4,765,217 | A | * | 8/1988 | Ludwig | 83/841 |
| 5,012,792 | A | * | 5/1991 | Kawata et al. | 125/15 |
| 5,056,395 | A | * | 10/1991 | Sovak et al. | 83/830 |
| 6,021,826 | A | * | 2/2000 | Daniell | 144/73 |
| 7,111,542 | B2 | * | 9/2006 | Taillon | 83/844 |

FOREIGN PATENT DOCUMENTS

| | | | |
|---|---|---|---|
| FR | 2 618 718 | * | 3/1989 |
| JP | 4-2410 | * | 1/1992 |

* cited by examiner

*Primary Examiner* — Clark F. Dexter
(74) *Attorney, Agent, or Firm* — Fay Sharpe LLP

(57) ABSTRACT

A quick change cutting link of a saw chain for cutting wood comprises a base member adapted to be pivotally connected to other links of the saw chain. The base member comprises a seat surface. A cutting member comprising a "V" notch releasably engages the seat surface of the base member. Attached to the "V" notch is a carbide tip, including a cutting edge. The carbide tip is accurately placed in the "V" notch by mating with a small piece of metal in the "V" notch. The carbide tip is then sinterbrazed to the cutting member. The cutting member and seat surface may also comprise an inverted L-shaped protrusion and the other includes an inverted L-shaped recess for receiving the inverted L-shaped protrusion. The inverted L-shaped protrusion and recess may be designed so as to form a wedge.

10 Claims, 5 Drawing Sheets

WOOD CUTTING SAW CHAIN AND REPLACEABLE CUTTING MEMBERS

This application is a continuation-in-part of U.S. patent application Ser. No. 10/780,323 entitled "Wood Cutting Saw Chain And Replaceable Cutting Members," filed on Feb. 17, 2004, the disclosure of which is herein incorporated herein by reference.

The present invention is directed to a chain for cutting wood such as chain saws and timber harvesters.

BACKGROUND OF THE INVENTION

There are a variety of cutting devices in numerous applications including masonry, machining, metal cutting, glass cutting, wood cuffing and stone cutting, which can employ a chain, rotary blade or other cutting element. Saw chains employ a chain design and material components unique to the particular application. In many cases the chain and teeth of one saw have a design that cannot be used in a saw for a different application. Also, chain tooth materials necessary for one application such as masonry, are not well suited to other applications such as wood cutting.

In the timber industry, saw chains of chain saws and timber harvesters are designed to cut the wood of trees. The conditions of wood to be cut influence the choice of material that is used for the cutting teeth of the saw chain. For example, under normal wood cutting conditions, saw chains having steel teeth are used. However, when cutting trees in an area where there are nails, staples or other metal articles that may have been inserted into the trees such as in areas near old farmland, saw chains employ more costly carbide-brazed steel cutting teeth because they can cut through metal articles in the tree and through the wood without becoming excessively dull.

The teeth of all saw chains undergo expected wear. This is typically addressed by the time-consuming process of sharpening the teeth or changing-out the dull chain with a sharpened chain. This delay in cutting causes a costly decrease in productivity of the cutting operation.

Attempts have been made to employ removable inserts usually made of steel. These inserts have taken on various designs but, in general, have been unsuccessful and are not used widely if at all. U.S. Pat. No. 2,583,243 discloses a chain saw which employs removable teeth which are wedged into the slot of a head of a saw chain link. U.S. Pat. No. 2,852,048 discloses a saw chain with removable cutter teeth having a T-shaped recess which engages a T-shaped element on a cutting link body. U.S. Pat. No. 3,547,167 discloses a removable cutting sleeve which has an opening that receives a stud of the cutting link body.

The typical saw chain material of teeth used to cut wood is one-piece stamped and machined metal (e.g., steel) which is not formed at close tolerances using conventional machining techniques. Commercially available wood-cutting saw chain teeth are permanently affixed to the chain. In applications where there is a risk of cutting into a tree containing metal pieces, saw teeth may employ a carbide article soldered to the metal tooth. Despite superior physical properties of brazed carbide teeth compared to steel teeth, their use is reserved for particular settings because of the added cost of the carbide material and soldering process. The wood cutting industry could benefit from saw chains including removable cutting teeth made from a material that makes the design economically feasible with superior physical properties compared to conventional stamped teeth that are permanently affixed to the chain.

SUMMARY OF THE INVENTION

In general, the present invention is directed to a quick change cutting link of a saw chain for cutting wood. A base or holder member of the cutting link is adapted to be pivotally connected to other links of the saw chain. The base member comprises a seat surface. A cutting member comprises a cutting edge and releasably engages the seat surface of the base member. The cutting member may comprise sintered and compacted particles of abrasion resistant material and, in particular, consists essentially of such material. The removable cutting member made of sintered and compacted particles of material can be formed into any insert design using any manner of fastening to the base of the cutting link. The inventive design is directed to the cutting link composed of the replaceable cutting member and cutting link base, to a saw chain comprising a plurality of the quick change cutting links, and to the cutting members and base members individually. The saw chain is any saw chain that is suitable for wood-cutting including, but not limited to, saw chain for use on a chain saw, a timber harvester, a buck saw and a saw for cutting wood pallets.

More specifically, the seat member of the base includes a first taper. The cutting member includes a surface having a second taper. The first and second tapers extend at an angle ranging from about 0.5° to about 45° relative to a direction of chain travel at a close tolerance effective to cause self-locking engagement of the first taper of the seat surface and the second taper of the cutting member surface. The close tolerance is characterized by variation in the angle being not more than about 1° and, in particular, not more than 0.5°. More specifically, the tolerance is on the order of not greater than 30 seconds. A specific linear tolerance of the taper in the present invention is +/−0.0005 inch.

The close tolerance of the first and second tapers resulting in the self-locking taper of the invention is believed to be a novel aspect of the present invention. One manner in which the present invention can achieve such close tolerances is by forming the cutting member so as to comprise sintered and compacted particles of abrasion resistant material (known as "sintered metal," "powdered metal" or "sintered ceramic"). Although use of this material is a significant inventive novel feature, the present invention is not limited to the use of sintered and compacted particles of material and the manufacturing technique for making it, in achieving such close tolerance. Use of sintered and compacted particulate metal or ceramic is a cost-effective technique known by the inventors to achieve the close tolerance. Other techniques for achieving the close tolerance are included within the scope of the invention. The base member may consist essentially of sintered and compacted particles of abrasion resistant material or the base member (e.g., composed of steel) may be formed with very close tolerances by progressive stamping.

The abrasion resistant material comprises at least one of metal and ceramic. One suitable ceramic material comprises a carbide containing compound selected from the group consisting of tungsten carbide, silicon carbide, tantalum carbide and aluminum carbide. A suitable metal material comprises a tool steel alloy.

A preferred form of the cutting member itself with a cutting edge comprises the tapered surface extending at an angle ranging from about 0.5° to about 45° relative to a direction of travel of the cutting member when fastened on a chain at a close tolerance characterized by variation in the angle being not more than 0.5°. The cutting member consists essentially of sintered and compacted particles of abrasion resistant material. The inventive design excludes cutting links using carbide studs which are brazed, cemented or otherwise permanently fastened to a steel base.

A preferred form of the base member itself has a design in which the base is adapted to be pivotally connected to other links of the saw chain. The base member comprises the seat surface having a taper extending at an angle ranging from about 0.5° to about 45° relative to a direction of travel of the cutting link when fastened on a chain at a close tolerance characterized by variation in the angle being not more than 0.5°. The base member consists essentially of sintered particles of abrasion resistant material.

A more particular design of the quick change cutting link comprises the base member adapted to be pivotally connected to other links of the saw chain. The base member comprises the seat surface having the first taper and a stop surface located upstream of the seat surface relative to the direction of travel of the chain. The cutting member comprises the cutting edge and releasably engages the seat surface of the base member. The cutting member includes a surface having the second taper. The first and second tapers extend at an angle ranging from about 0.5° to about 45° and the cutting member consists essentially of sintered and compacted particles of abrasion resistant material.

Additional aspects of the cutting link designs described above will now be described. The self-locking taper of the invention is formed by at least one tapered surface on the seat (i.e., on an upper, lower or side surface of the geometry of the seat) and a corresponding taper on the cutting member that engages the seat tapered surface. The cutting member includes the recess and the holder includes the protrusion, or vice versa. For example, one of the seat surface and the cutting member has an inverted-L shaped protrusion (e.g., the seat surface) and the other has an inverted-L shaped recess for receiving the inverted-L shaped protrusion (e.g., the cutting member). This inverted L-shaped protrusion and inverted L-shaped recess may include at least one tapered surface selected from the upper, lower and side surface of a short leg or long leg thereof, which facilitates fastening the cutting member to the holder by creating a self-locking taper. The upper surface of the short leg may be flat and the lower short leg surface tapered or vice versa; both the upper and lower short leg surfaces may be tapered; both the upper and lower short leg surfaces may be flat and a side surface of the inverted L-shaped projection tapered, or any combinations of the above such as a flat upper short leg surface, tapered lower short leg surface and tapered side surface of the inverted L-shaped member, along with corresponding surfaces in the other member (e.g., the cutting member) having a taper that engages at least one tapered surface at the close tolerance effective to create the self-locking action.

Regarding further features of the cutting link designs, the first and second tapers may extend upwardly or downwardly from a location near the cutting edge in a direction opposite to the direction of chain travel. The taper angle of the seat surface and corresponding cutting member surface is, in particular, about 10° or less. The cutting member includes a leading surface relative to the direction of chain travel which forms the cutting edge at an upper location of the leading surface. The leading surface has a radius of curvature for a given chain pitch that is proportional to a radius of about 0.25 inch for a chain pitch of 0.750 inch. In other words, about 0.25 inch is the leading edge radius for a large 0.750 pitch chain. The radius of curvature of the leading surface would be proportionally smaller for smaller pitch chains. The curvature is concave relative to a point of reference external of the cutting member. At least one of the cutting member and base member comprises a water-resistant material applied by a process selected from the group consisting of steam treatment, resin infiltration, copper infiltration and loctite infiltration.

An advantage of designing the cutting member of sintered and compacted particulate material is that the material may advantageously be formed in near final net shape and used as processed with little machining except for grinding of the cutting edge. This enables the uniquely close tolerance of the tapers to produce a self-locking engagement of the cutting member and the base member. In use, the sintered material cutting member is placed near the seat surface and slid onto it in a direction opposite to the direction of chain travel. The self locking tapers of the cutting member and holder provide effective and strong self-locking connection between the cutting member and holder. Once in the locked position, the cutting member can only be removed by tapping it from the rear or using a specialized tool that applies force in the direction of chain travel. This provides for safe and effective installation and removal (i.e., quick change) of the cutting members on the holders. Because the self-locking taper is quick and effective in securing the cutting member to the holder, other fasteners are not necessary in the inventive design. The sintered and compacted material has much better hardness and durability compared to steel teeth, which may dramatically extend chain life compared to steel teeth and is believed to surpass previously attempted chain insert designs in quality and economics of manufacture. Fabrication of the cutting members is expected to be more efficient compared to carbide brazed steel teeth. The cutting members are not fastened with a costly brazing process which would adversely prevent the quick change feature of the invention.

The present invention is expected to change the way dull or damaged saw chains and teeth are changed out in the field. Instead of the time-consuming chain sharpening by hand by workers or outright replacement with a sharp chain, the quick change chain of the present invention enables individually worn or damaged cutting members to be easily removed by tapping them off the chain or by using a specialized tool. In addition, the inventive base members may be used to replace damaged base members of a saw chain. When the entire chain is worn, the worker simply obtains a set of sharp cutting members, removes all of the worn cutting members, and slides the sharp cutting members on the chain. No separate fasteners such as screws need to be used to enable removal or installation of the cutting members. The present invention avoids having to replace the entire chain and to sharpen the chain. The worker may collect dull cutting members and ship them to the manufacturer for sharpening. Thus, there is potentially less risk of injury to workers, and potentially fewer worker compensation claims for the employer, because use of the inventive saw chain avoids the need for a worker to push a file near sharp cutters during typical sharpening in the field.

It should be understood that the present invention is not limited by descriptive terms such as left, right, front, back, top, vertical and the like, as these terms are provided to improve understanding and apply to the views shown in the drawings. These relative terms can differ upon change in the orientation and position of the chain and teeth.

Other embodiments of the invention are contemplated to provide particular features and structural variants of the basic elements. The specific embodiments referred to as well as possible variations and the various features and advantages of the invention will become better understood from the accompanying drawings in conjunction with the following detailed description.

DETAILED DESCRIPTION

Figure 1:
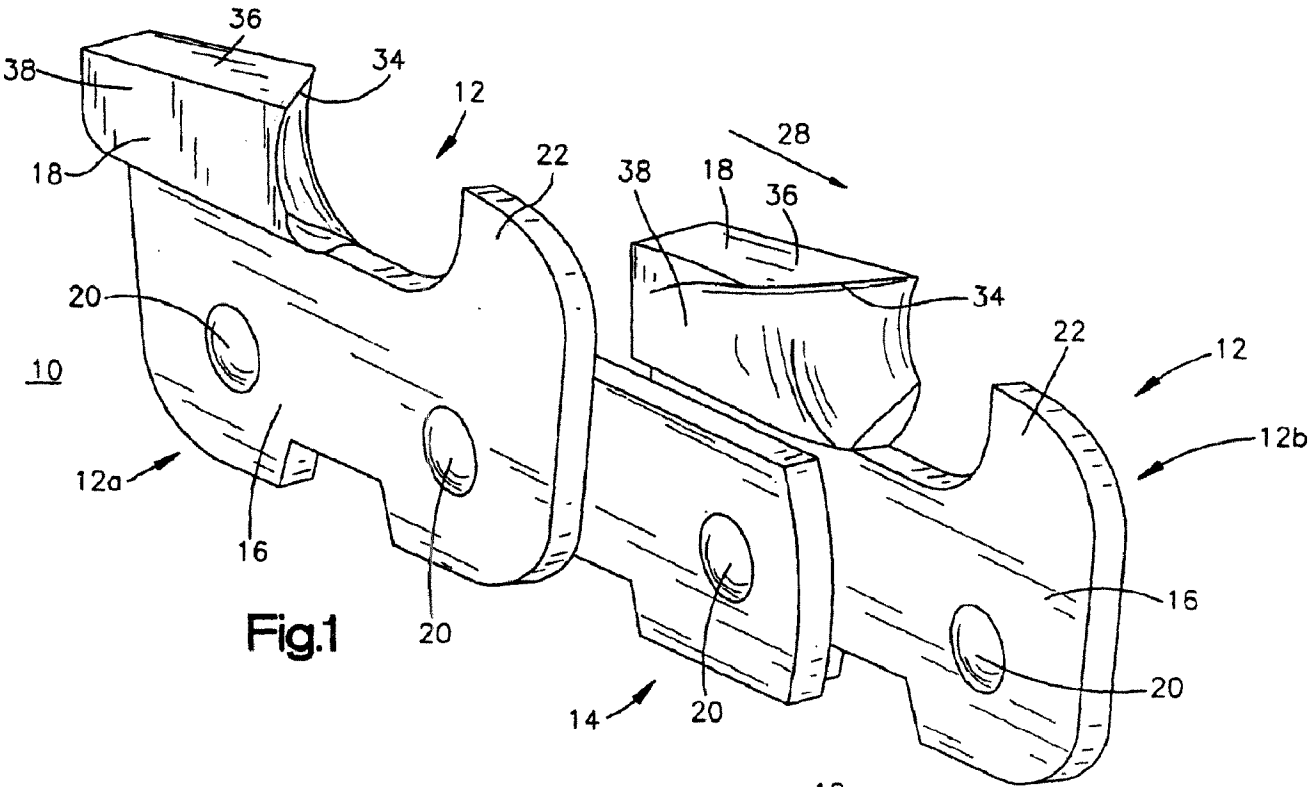
FIG. 1 is a perspective view of a portion of saw chain including right and left-handed cutting links constructed in accordance with the present invention.
Figure 2:
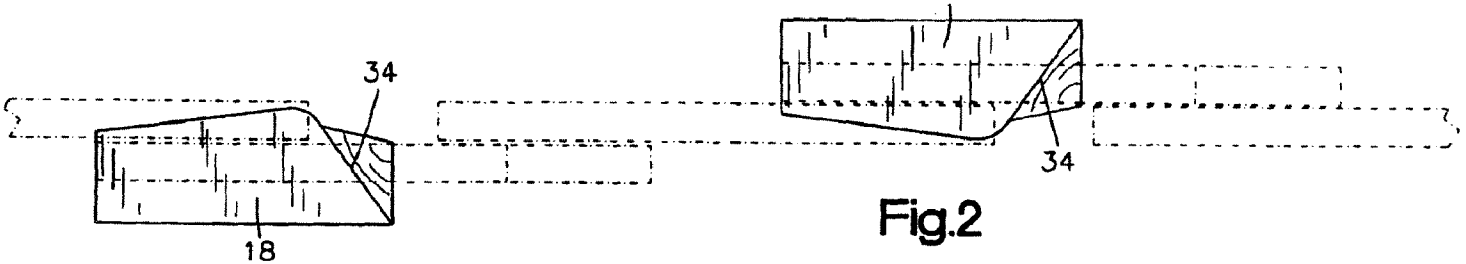
FIG. 2 is a top plan view of the replaceable inventive cutting members of the cutting links shown in FIG. 1.

Turning now to the drawings, the inventive saw chain portion 10 includes a plurality of links including cutting links 12 and connecting links or tie-straps 14 located between the cutting links, which pivotally connect the cutting links and drive links (not shown) together in a well known manner. The cutting links or cutters 12 each comprise a holder or base member 16 pivotally connected at each end to the connecting links and quick change cutting members 18 connected to the holders. The cutting links are designed so as to alternate right and left handed with regard to the cutting edge (12*a*, 12*b*, respectively, in FIGS. 1 and 5) such that they are a mirror image of one another relative to a plane in which the connecting links reside. Rivets 20 pivotally fasten the saw chain links together in a well known manner. The function of the cutters and the purpose of their design is to cut wood fibers. Those skilled in the art will appreciate in view of this disclosure that a complete saw chain includes other conventional links (not shown) that are connected to the cutting links of the saw chain portion shown in FIG. 1. Drive links or drivers (not shown) are adapted to drive the chain in a well known manner. For example, in chain saws the drive links have a conventional design which engages the chain saw drive sprocket and a sprocket at the end of the guide bar (not shown).

The inventive cutting links may be employed with associated links enabling use in any standard wood-cutting chain design. For example, the cutting links may be used in full compliment, semi-skip (half-skip), and full skip chains, which designations refer to the number of tie-straps between cutters. In the 2003 website by Manufacturer's Supply Inc., which is incorporated herein by reference in its entirety, a full compliment a chain is described as chain having a first cutter, a tie strap and another cutter (e.g., a right cutter, a tie-strap, a left cutter, a tie strap, a right cutter, etc.); a semi-skip chain is described as having alternating one and two tie-straps after cutters (e.g., a right cutter, a tie-strap, a left cutter, two consecutive tie-straps, a right cutter, etc); full skip chain is described as having two tie-straps after cutters (e.g., a right cutter, two consecutive tie-straps, a left cutter, two consecutive tie straps, a right cutter, etc.). The inventive cutting link is suitable for use in all chain pitches (i.e., the distance between three consecutive rivets divided by two) including ¼, 0.325, ⅜, ⅜ extended, 0.404, ½ and 0.750 inch pitches. The inventive cutting link is designed for use in wood-cutting chains including, but not limited to, chains for timber harvesters, chain saws, buck saws and saws for cutting wood pallets.

Links of the chain include rakers or depth gauges 22, which set the depth of the cutter (i.e., the thickness of the wood chip that is cut). The holders themselves may include a raker in the exemplary design shown in FIG. 1. Alternatively, other links of the chain may include a raker upstream of a cutter such as on a drive link.

Figure 4:
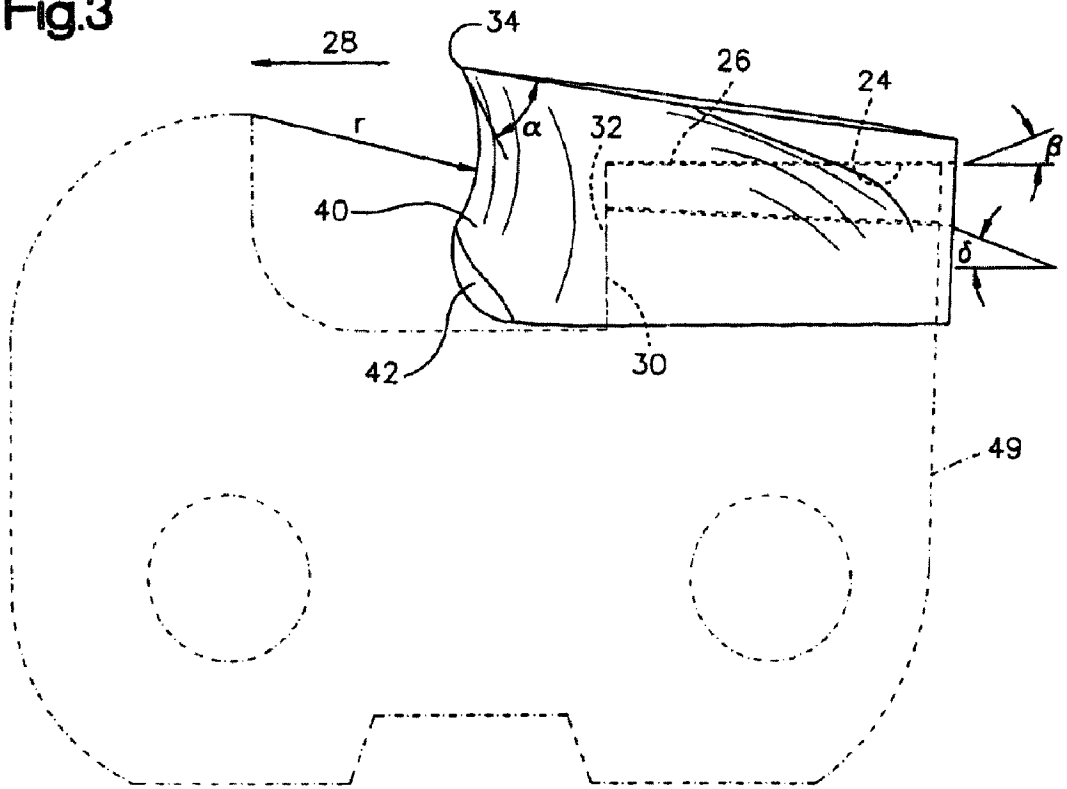
FIG. 4 is a side view of the cutting member shown in FIG. 3 showing a self-locking taper-and-wedge design in accordance with the present invention.
Figure 6:
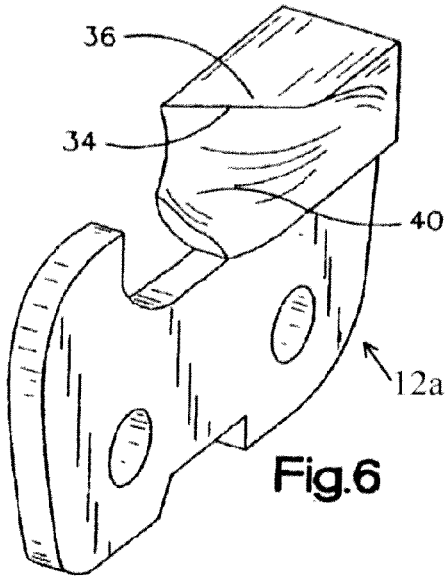
FIG. 6 is a perspective front view of the right-handed cutting link shown in FIG. 1.
Figure 7:
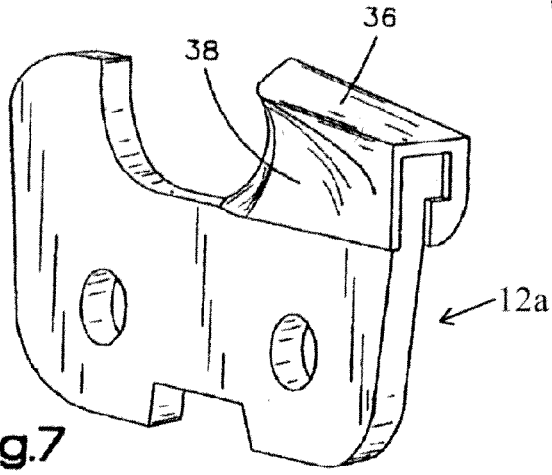
FIG. 7 is a perspective rear view of the right-handed cutting link shown in FIGS. 1 and 6.
Figure 8:
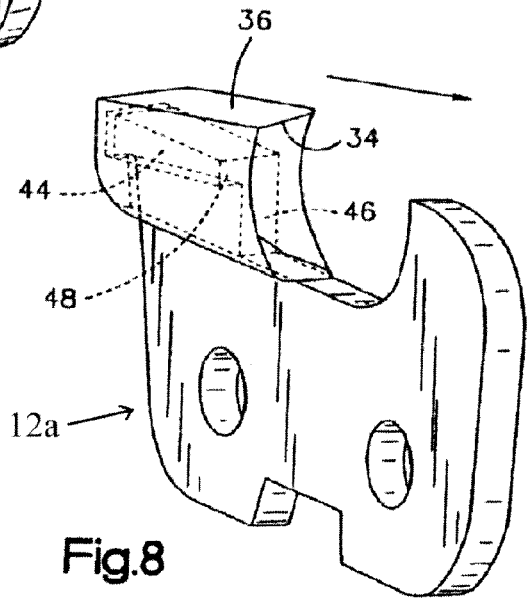
FIG. 8 is a perspective front view of the right-handed cutting link shown in FIG. 1 showing the self-locking taper-and-wedge design in accordance with the present invention.

As shown in FIGS. 4 and 8, the cutting member has an internal tapered surface 24 which engages a tapered seat surface 26 of the holder. The seat surface 26 is also referred to as a wedge. The tapered surfaces 24 and 26 extend in the general direction of chain travel 28 and engage each other such that the taper and wedge are self-locking. The cutting member has an abutment surface 30 that extends generally vertically in the view of FIG. 4 and abuts against a stop surface 32 which extends generally vertically in the view shown in FIG. 4, transverse to the chain travel direction, and leads to the seat surface 26 of the holder. Each cutting member comprises a cutting edge 34 that penetrates the wood fibers. Another part of the cutting member is the top surface 36 which affects the width of the saw kerf. The cutting member has side surfaces 38. The cutting member has a chisel angle $\alpha$ as shown in FIG. 4 that finishes making the cut and pushes chips from the saw kerf, which is about 80° or other suitable conventional angle. A leading or front surface 40 of the cutting member forms the cutting edge at an upper surface thereof. The leading surface 40 has a radius of curvature r (FIG. 4) for a given chain pitch that is proportional to a radius of about 0.25 inch for a chain pitch of 0.750 inch. In other words, about 0.25 inch is the radius of curvature for a large 0.750 pitch chain (as shown in FIG. 4). The radius of curvature of the leading surface, and preferably of all dimensions and geometries of the entire cutting member and holder, would be proportionally smaller for smaller pitch chains. A beveled surface 42 (FIG. 4) provides relief enabling good flow of wood chips. A novel aspect of the present invention is that the taper of the cutting member and the wedge of the seat surface of the holder contact each other effective to enable the cutting members to be self-locking. The taper on the cutting member and taper or wedge on the seat surface of the holder extend at an angle $\beta$, $\delta$ and $\lambda$ (the angle designation being exaggerated in FIG. 4 for improving clarity) ranging from 0° to about 45°, preferably from 0.5° to about 45°, at a close tolerance effective to cause the self-locking taper-and-wedge. Angles $\beta$, $\delta$ are taken relative to the chain travel direction 28 while angle $\lambda$ is taken perpendicular thereto. The close tolerance is characterized by variation in the angle being not more than about +/−1° and, in particular, not more than +/−0.5°. In the design shown, the holder seat surface 26 (FIG. 4) extends at angle $\beta$ of 0°. The cutting member surface 24 also extends at angle $\beta$ of about 0°.

Figure 5:
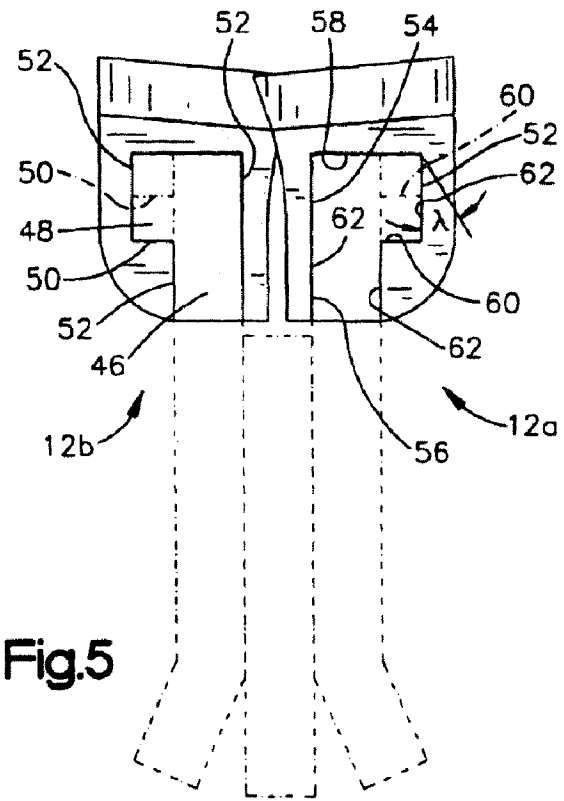
FIG. 5 is a rear view of left and right-handed cutting members of the chain shown in FIG. 1.
Figure 3:
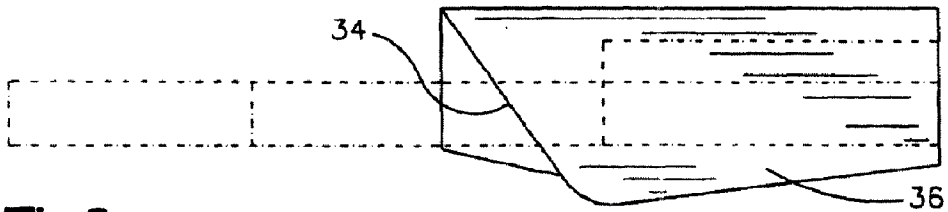
FIG. 3 is a top plan view of one of the inventive cutting members.

As shown in FIGS. 4, 5 and 8, the seat surface of the holder has an inverted L-shaped protrusion 44 having a long leg 46 and short leg 48. Seat surface 26 forms an upper surface of the short leg 48 and extends from near the cutting edge in the direction opposite to the chain travel direction toward rear surface 49. A lower wedge surface 50 of the short leg extends at an angle $\delta$ of about 10° downwardly from near the cutting edge in the direction opposite to the chain travel direction. The L-shaped member includes side surfaces 52 (FIG. 5, right side) extending at angle $\lambda$.

Similarly, the tapered cutting member includes an inverted L-shaped interior recess 54 having a long leg recess surface 56 and a short leg recess surface 58 (FIG. 5, right side). The surface 24 of the cutting member forms the upper short leg recess surface 58 and extends at angle $\beta$ from near the cutting edge in the direction opposite to the chain travel direction (β is 0° in FIG. 4). A lower tapered interior recess surface 60 of the cutting member, corresponding to the lower surface 50 of the short leg (FIG. 5, left side), extends at the angle δ downwardly from near the cutting edge in the direction opposite to the chain travel direction (δ is 10° in FIG. 4). The L-shaped interior recess includes interior side surfaces 62 (FIG. 5) extending at angle λ (which is 0° in FIG. 4).

The L-shaped protrusion and recess connect the cutting member to the holder with a self-locking taper-and-wedge action caused by engagement of at least one tapered surface of the cutting member with a tapered or wedge surface of the holder such that at least one of the angles β, δ or λ ranges from 0.5 to 450. For example, the taper may be on the upper surface of the inverted L-shaped member, the lower surface of the inverted L-shaped member, the side surface of the inverted L-shaped member, or combinations thereof, as well as on the corresponding, engaging surface of the insert. Any of the surfaces 26, 50, 52 may be seat surfaces. In the illustrated design, the short leg of the L-shaped protrusion, and corresponding L-shaped recess, increase in height in the direction opposite to chain travel (i.e., the upper short leg surface being flat and the lower short leg surface being downwardly extending from near the cutting edge in the opposite direction toward the rear of the cutting link) to form the wedging action.

The present invention includes any cutting member designs of various external shapes, whether they are curved in the region of the cutting edge as shown or straight, whether they have variations in side surfaces and geometries of locking surfaces such as fastening surfaces different from the inverted L-shaped recess and projection shown, so long as the cutting members include the inventive self-locking taper-and-wedge and/or are formed of sintered and compacted particles of material. For example, the holder may include a recess having an inverted L-shape or other geometry and the cutting member may include a protrusion of corresponding shape so as to form the inventive self-locking taper-and-wedge.

One manner for achieving the inventive self-locking taper is to form the cutting member and/or the holder from a sintered and compacted particulate material. Sintered and compacted particulate material means a material which consists essentially of compacted and sintered particles of abrasion resistant material. The particulate material may comprise a ceramic or metal, abrasion resistant material. A suitable ceramic material for use as a sintered and compacted particulate material is a powder of a carbide containing compound, for example, tungsten carbide, silicon carbide, tantalum carbide and aluminum carbide, which may be supplied, for example, by Reade Advanced Materials. Another suitable ceramic material is tungsten carbide powder supplied by Sylvania. Yet another suitable ceramic is boron carbide powder supplied by Toshiba.

Figure 9:
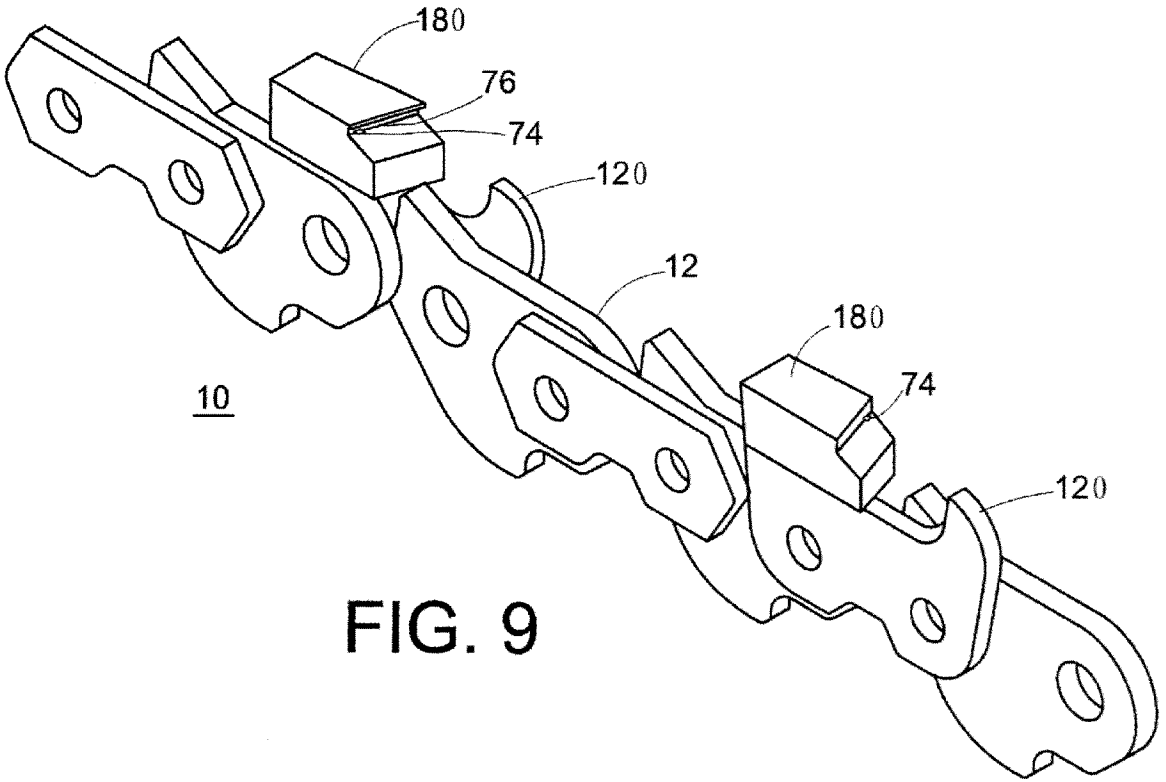
FIG. 9 is a perspective view of a portion of saw chain including cutting members comprising a "V" notch.
Figure 10:
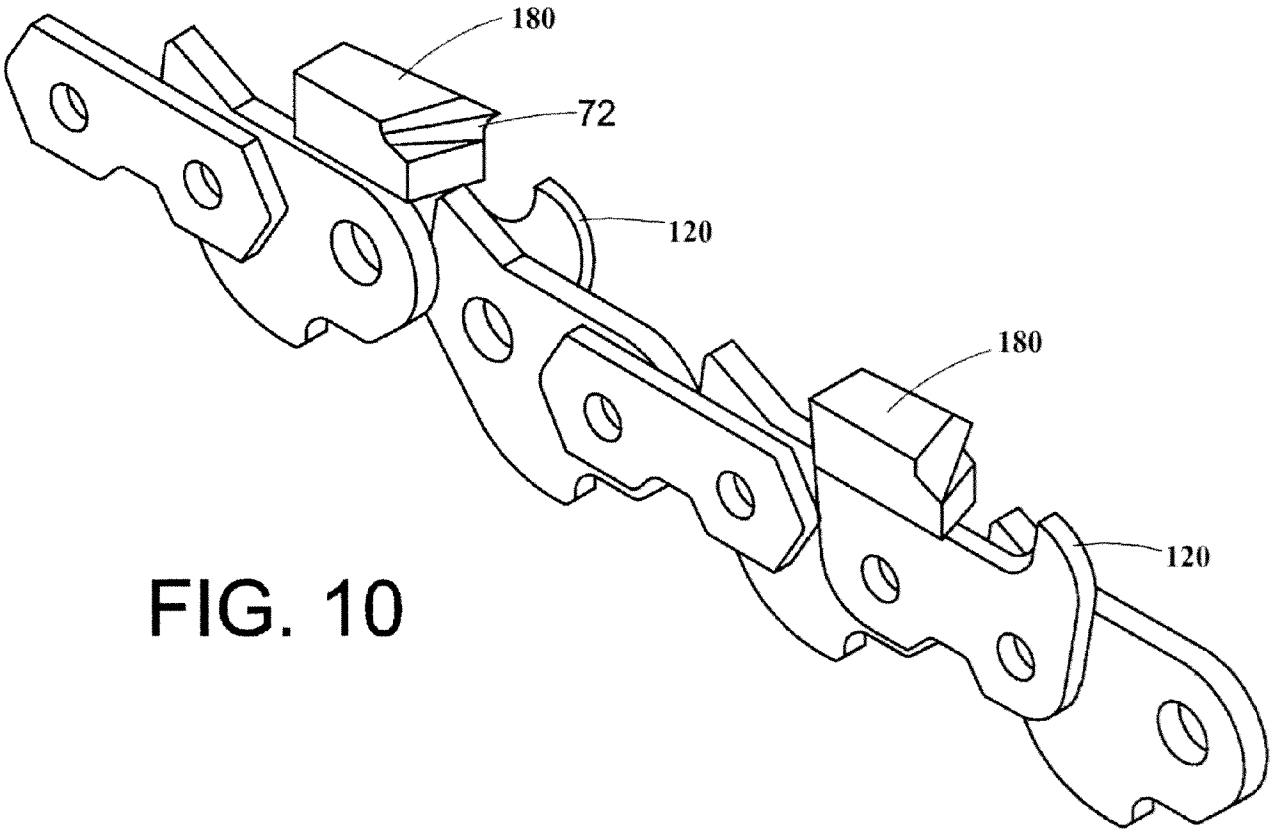
FIG. 10 is a perspective view of a portion of saw chain including cutting members comprising carbide cutting tips.

Another embodiment of the present invention, displayed in FIGS. 9 and 10, includes a cutting link 120 having a carbide cutting tip attached to the cutting members 180. The cutting member 180 comprises a V-shaped notch 76 in the face of the cutting member body facing the cutting direction, in which the carbide tip 72 is attached. The V-shaped notch 76 increases the bonding surface and provides a stronger design than placing a piece of carbide directly to a perpendicular piece of metal. The carbide tip 72 may preferably be attached using the sinterbrazing process; however, any method of attachment known in the art may be used. The sinterbrazing material may be in the form of a paste or a powder. The sinterbrazing material is applied to the V-shaped notch 76 and the carbide tip is placed on top, with the cutting edge of the carbide tip 72 facing the cutting direction.

Preferably, the V-shaped notch 76 comprises a small portion of powdered metal 74 in the corner of the notch to act as a placeholder for the carbide tip 72. The carbide tip preferably has a near net shape with a small corner missing (not shown), the small missing corner referred to as a detent, to mate with the powdered metal portion 74 in the deepest recess of the V-shaped notch 76. The powdered metal portion sits in the deepest recess of the V-shaped notch in the inside portion of the cutting member 180. The powdered metal portion 74 guides the carbide tip to its proper position and keeps the tip properly located during the attachment process. After placing the carbide tip 72 correctly upon the V-shaped notch 76, the entire cutting member 180 is placed in a furnace at a temperature sufficient to melt the brazing material and bond the carbide tip 72 to the metal cutting member 180.

Without the powdered metal portion in the V-shaped notch 76, manufacturers must grind the edges of the carbide piece three or four times, depending on whether the cutter is a full chisel or a semi-chisel respectively, compared to just once, as is described in the present invention. Only the face of the tip must be ground, while other methods require the grinding of all edges due to the inability to locate the carbide position effectively.

Exemplary metal compounds which are suitable for use as the sintered and compacted particulate material are typically accepted tool steels including, but not limited to, A2, D2 and M2 AISI designations of air hardening tool steels which may be supplied, for example, by Carpenter Steels or Pacific Sintered Metals and are known to possess excellent impact resistance. The following are the chemical compositions of the exemplary A2, D2 and M2 AISI designations of air hardening tool steels alloys suitable for use as sintered and compacted metal materials for forming the cutting members and/or the holders of the present invention.

A2 consists essentially of 1.0% carbon, 0.8% manganese, 0.3% silicon, 5.25% chromium, 1.10% molybdenum, 0.2% vanadium with the balance being iron and unavoidable impurities. D2 consists essentially of 1.5% carbon, 0.5% manganese, 0.3% silicon, 12% chromium, 0.8% molybdenum, 0.9% vanadium with the balance being iron and unavoidable impurities.

M2 consists essentially of 0.82% carbon, 0.3% manganese, 0.25% silicon, 4.25% chromium, 5% molybdenum, 6.25% tungsten, 1.8% vanadium with the balance being iron and unavoidable impurities. Information and fabrication services from Pacific Sintered Metals regarding an M2 alloy and other "fully dense" or "near fully dense" powdered metals (i.e., a density close to theoretical density as known in the powdered metal or powdered ceramics industry), which are suitable for fabricating the cutting members and/or base members of the present invention as apparent to one skilled in the art in view of this disclosure, is available from that company or provided on its website (www.pacificsintered.com) dated Jan. 7, 2004, which is incorporated herein by reference in its entirety.

L6 consists essentially of 0.7% carbon, 0.35% manganese, 0.25% silicon, 1.00% chromium, 1.75% nickel with the balance being iron and unavoidable impurities.

A general method for manufacturing the cutting members and/or holders includes obtaining commercially available powdered ceramic and/or metal particles. The powder, along with suitable lubricants and/or binders, will be conveyed into a compaction die. A bottom punch, a top punch and any necessary core pins will enter the die. Pressure will be applied effective to achieve "green" strength sufficient to enable handling of the component and subsequent density and strength. The top punch will retract and the bottom punch will eject the component. The molded green component will then be sintered at a temperature effective to achieve desired density. This will bind the particles of ceramic and/or metal together. The component may be induction heat treated to increase strength and hardness in the case of sintered metal and sent to a grinding operation to sharpen the cutting edge to a desired angle(s). This procedure may also apply to the holder or the holder may be made by stamping in a progressive die in a stamping press in a known manner.

One skilled in the art can, in view of this disclosure, utilize conventional fabrication techniques and specific processing conditions or the fabrication services of powdered metal or powdered ceramic component manufacturing companies, to make the inventive cutting members and holders out of sintered metal particulates or sintered ceramic particulates. Companies which can fabricate the inventive cutting members or holders from sintered or powdered metal or ceramics include GKN Worldwide, Metaldyne, Pacific Sintered Metals, Federal Mogal and Coors ceramics. At least some of these companies put water resistant sealants on sintered metal components such as gears used in engines, transmission gears and the like. Therefore, such companies would also be able to use routine skill in view of this disclosure to put a water sealant on the inventive sintered metal cutting members and/or holders, to avoid rust in view of their iron component, using a process that is adapted for use on the component and its composition including, but not limited to: steam treatment, resin infiltration, copper infiltration and loctite infiltration. This will inhibit rusting of the inventive cutting members and holders in the field.

More specifically, the following fabrication procedure may be used in the case of a cutting member comprised of ceramic. Those skilled in the art of sintered component manufacture in reading this disclosure will understand suitable processing parameters to employ in manufacturing the inventive cutting members. A powdered ceramic material that is suitable for fabrication as a sintered particulate material of the present invention is selected. The material should have sufficient heat and abrasion resistance and toughness. Those skilled in the art will appreciate that some ceramic materials which otherwise have sufficient abrasion resistance to be used as a cutter on saw chain may be unsuitably brittle. One suitable ceramic material is believed to be tungsten carbide. Powdered ceramic is added to suitable lubricants such as a compound comprising stearate (e.g., zinc stearate). The composition may also include suitable binder (e.g., Acrawax® or Carbowax®). The composition is then charged into the die and compacted at a pressure effective to form a robust component that can withstand handling (e.g., a die compaction pressure on the order of 15 tons or less in the case of a single cavity die). After discharge from the die the component is sintered in a suitable atmosphere under conditions effective to achieve desired density of the component. For tungsten carbide, suitable sintering conditions may be a neutral or slightly oxidizing atmosphere at a temperature on the order of 1800° C. or less for a minimum of 2 hours until full densification is achieved.

In use, the cutting member of sintered particulate material is placed near the seat surface and slid onto it in the direction opposite to the chain travel direction. The self locking tapered surface of the cutting member and wedge of the seat, provide an effective and strong locking connection between the cutting member and holder. The cutting member can only be removed by tapping it or by using a specialized tool that applies force in the chain travel direction. This provides for safe and effective installation and removal (i.e., quick change) of the cutting members on the holders. During the cutting operation, forces between the cutting members and the wood cannot dislodge the cutting members. In addition, in view of the self-locking fastening of the cutting member to the holder, moderate forces on the rear of the cutting members in the chain travel direction, as in the case of removing a chain saw guide bar that is binding to a log, should not easily dislodge the cutting members.

Although the invention has been described in its detailed form with a pertain degree of particularity, it will be understood that the present disclosure of the detailed description and preferred embodiments have been made only by way of example and that various changes and modifications can be resorted to without departing from the true spirit and scope of the invention as hereafter claimed.

The invention claimed is:

1. A quick change cutting link for a saw chain for cutting wood, comprising:

a base member adapted to be pivotally connected to other links of the saw chain, said base member comprising a seat surface having a first taper, a cutting member including a surface, said surface having a second taper extending along a length of said cutting member, said cutting member further including a V-shaped notch extending along a width of said cutting member, the V-shaped notch including a portion of powdered metal dispersed in a corner of said V-shaped notch at a location along only a portion of said width, wherein said second taper of the cutting member surface engages said first taper of said seat surface, releasably mounting and self-locking said cutting member to said base member, and a carbide tip seated within said V-shaped notch, said carbide tip having a mating surface shaped cooperatively with said V-shaped notch, said mating surface including a detent receiving said powdered metal portion, wherein said base member, said cutting member, and said carbide tip comprise a single link.

2. The cutting link of claim 1, wherein said carbide tip further includes a cutting surface.

3. The cutting link of claim 1, wherein said portion of powdered metal is located in the deepest recess of said V-shaped notch opposite a leading edge of said cutting member.

4. The cutting link of claim 1, wherein a sinterbrazing material secures said carbide tip to said cutting member.

5. The cutting link of claim 4, wherein said sinterbrazing material comprises one of a powder and a paste.

6. The cutting link of claim 1, wherein only one edge of the carbide tip is sharpened.

7. The cutting link of claim 1, wherein one of said seat surface and said cutting member includes an inverted L-shaped protrusion and the other of said seat surface and said cutting member includes an inverted L-shaped recess for receiving said inverted L-shaped protrusion.

8. The cutting link of claim 7, wherein one of said first taper and second taper forms a surface of said L-shaped protrusion.

9. The cutting link of claim 7, wherein said first taper and said second taper form angles.

10. The cutting link of claim 9, wherein at least one of the angles range from 0.5 to 45°.

* * * * *